United States Patent [19]

Schrudde et al.

[11] Patent Number: 4,643,113

[45] Date of Patent: Feb. 17, 1987

[54] CHAIN STITCH SEWING MACHINE

[75] Inventors: Reinhold Schrudde, Oerlinghausen-Lipperreihe; Rainer Lohe, Oerlinghausen; Klaus Hampel, Bielefeld, all of Fed. Rep. of Germany

[73] Assignee: Kochs Adler, AG, Fed. Rep. of Germany

[21] Appl. No.: 702,038

[22] Filed: Feb. 15, 1985

[30] Foreign Application Priority Data

Mar. 27, 1984 [DE] Fed. Rep. of Germany ..... 3411217

[51] Int. Cl.[4] ..... D05B 1/10; D05B 27/22; D05B 57/02

[52] U.S. Cl. ..... 112/199; 112/310; 112/315

[58] Field of Search ..... 112/167, 197, 199, 201, 112/310, 315, 165

[56] References Cited

U.S. PATENT DOCUMENTS

| | | | |
|---|---|---|---|
| 1,659,443 | 2/1928 | Redin | 112/165 X |
| 2,292,724 | 8/1942 | Thompson et al. | 112/197 |
| 3,285,210 | 11/1966 | Tretow et al. | 112/199 |
| 3,457,888 | 7/1969 | Wider | 112/201 |
| 3,742,880 | 7/1973 | Franz | 112/199 |

FOREIGN PATENT DOCUMENTS 3313981 4/1983 Fed. Rep. of Germany .

*Primary Examiner*—Wm. Carter Reynolds

*Attorney, Agent, or Firm*—Laff, Whitesel, Conte & Saret

[57] ABSTRACT

A double chain stitch sewing machine having a feeding device with a feed dog oscillatingly movable in and opposite to the feeding direction for producing a relative movement between a workpiece and the sewing machine. It has a needle reciprocatingly driven by a crank mechanism, at which the feeding mechanism also imparts synchronous jogging movements to the needle in order to generate a needle feed movement. The reciprocatingly and joggingly driven needle cooperates with a looper oscillatingly driven by a looper drive mechanism in parallel with the feeding direction. The looper drive mechanism is formed as a six-bar-linkage-mechanism provided at the input with a stationary pivot and at the output with a stationary pivot and provided with an intermediate pivot. The looper is oscillatingly swung at a relative high velocity from one extreme position to the other at an input motion with constant angular velocity and the looper is moved with a short period of dwell in that extreme position located in the feeding direction and moved with long period of dwell in that extreme position located oppositely to the feeding direction.

5 Claims, 12 Drawing Figures

CHAIN STITCH SEWING MACHINE

FIELD OF THE INVENTION

In general this invention relates to a two thread chain stitch sewing machine using a needle thread and a looper thread provided with a feeding mechanism for advancing a workpiece and for synchronously jogging the needle reciprocatingly driven by a crank mechanism in order to generate a needle feed movement, wherein the needle cooperates with a looper oscillatingly moved in parallel with the needle feed movement. In particular, this invention relates to a mechanism for driving the looper.

BACKGROUND OF THE INVENTION

Chain stitch sewing machines of such types basically incorporate the advantage that they can be run at comparably high RPM-rates without any problems. A basic problem however at such type of sewing machine does exist as to such drive the looper as to achieve reliable conditions at the instant of the needle thread loop pick-up and at the instant when the descending needle enters a thread triangle for the double thread chain stitch formation.

German Offenlegungsschrift No. 33 13 981 describes a looper drive mechanism for a sewing machine of the aforesaid type incorporating a stitch length adjustable workpiece feed mechanism. At this machine basically the path described by the tip of the looper remains unaltered, however this path as a total is such as displaced that the distance between the tip of the looper and a vertical line represented by the needle positioned in its lower dead center remains always almost constantly. This oscillating at constant amplitude is such as induced that at increasing of the stitch length resp. feed rate the initial point of the path described by the tip of the looper will be moved away from the described vertical line. At a reduction of the stitch length resp. of the feed rate the initial point of the path described by the tip of the looper will be moved towards the described vertical line.

U.S. Pat. No. 3,285,210 also describes a looper drive mechanism for a chain stitch sewing machine of the aforesaid type, at which the looper is oscillatable at a constant amplitude. At stitch length resp. feed rate alterations the path of the looper is such as displaced at maintaining its constant amplitude in the feed direction transversal to the latter, so that about a constant distance is achieved between the tip of the looper and the vertical line represented by the needle positioned in its lower dead center.

SUMMARY OF THE INVENTION

It is an object of this invention to create a looper drive mechanism for the above mentioned type of sewing machine to increase the thickness of the workpiece to be processed at the employment of a usually formed looper.

It is a further object of this invention to propose a chain stitch sewing machine of the aforesaid type, which renders possible the generation of a stitch row formed by stitches having an increased stitch length.

Still a further object of this invention is to propose a double chain stitch sewing machine, at which the aforementioned objects are achieved at simultaneously increasing the reliability of the double chain stitch formation and to increase the durability of the machine.

The present invention provides a chain stitch sewing machine of the aforesaid type with a looper drive mechanism formed as a six-bar-linkage-mechanism including three stationary pivots. A linkage mechanism of such type generates a designated looper motion as to positively effect a safe stitch formation, i.e. in particular, to form a safer needle thread loop seizing by the looper on one hand and to assure a safe entering of the descending needle into the thread triangle built by two legs of the needle thread and one leg of the looper thread in coaction with a spreader on the other hand. Due to the specific type of linkage mechanism the looper is oscillatingly swung at a relative high velocity from one extreme position to the other at an input motion of constant angular velocity. Furthermore, the looper is moved with a short period of dwell in that extreme position located in the feeding direction of the workpiece and moved with a long period of dwell in that extreme position located oppositely to the feeding direction of the workpiece. Due to the high velocity with which the looper passes the needle, the collision range between both is minimized, so that in total the amount of needle stroke can be increased, i.e. the processable thickness of the workpiece can be increased. Moreover, large stitch lengths are obtained due to the specific looper motion as described. At these advantages the length of the looper, i.e. the looper blade does not need to be increased. Even if there is provided a stitch length alteration, i.e. if the feed dog movement including the corresponding needle feed movement is alterable, the looper drive mechanism according to the invention leads to optimal results due to the specific achieved looper movements inclusive the high velocities in the described areas, wherein the looper passes a relative large oscillatory angle as the needle is moved for a relative small amount of stroke only.

In addition to these positive features the looper is moved back through the needle scarf, so that no formation of a burr resp. a scarfing of the needle can arise, thus also avoiding any damaging of the thread.

In case that the feed rate resp. stitch length is alterable then it is especially advantageous to adjustably arrange the intermediate pivot of the three stationary pivots of the above mentioned six-bar-linkage-mechanism. The employment of the six-bar-linkage-mechanism together with the adjustment possibility as described gives also further advantages.

The looper drive mechanism according to the invention is a so called planear gear type, i.e. all movements are carried out in planes parallel to each other. A further fundamental advantage of the looper drive mechanism according to the invention is obtained by the fact, that the commonly used crank mechanism for the needle drive can be maintained, i.e. no modifications have to be carried out at the needle bar drive in order to obtain the looper movements.

Numerous further advantages and features of the invention will become apparent from the following description of embodiments in connection with the drawings in which:

DESCRIPTION OF THE PREFERRED AND MODIFIED EMBODIMENTS

Figure 1:
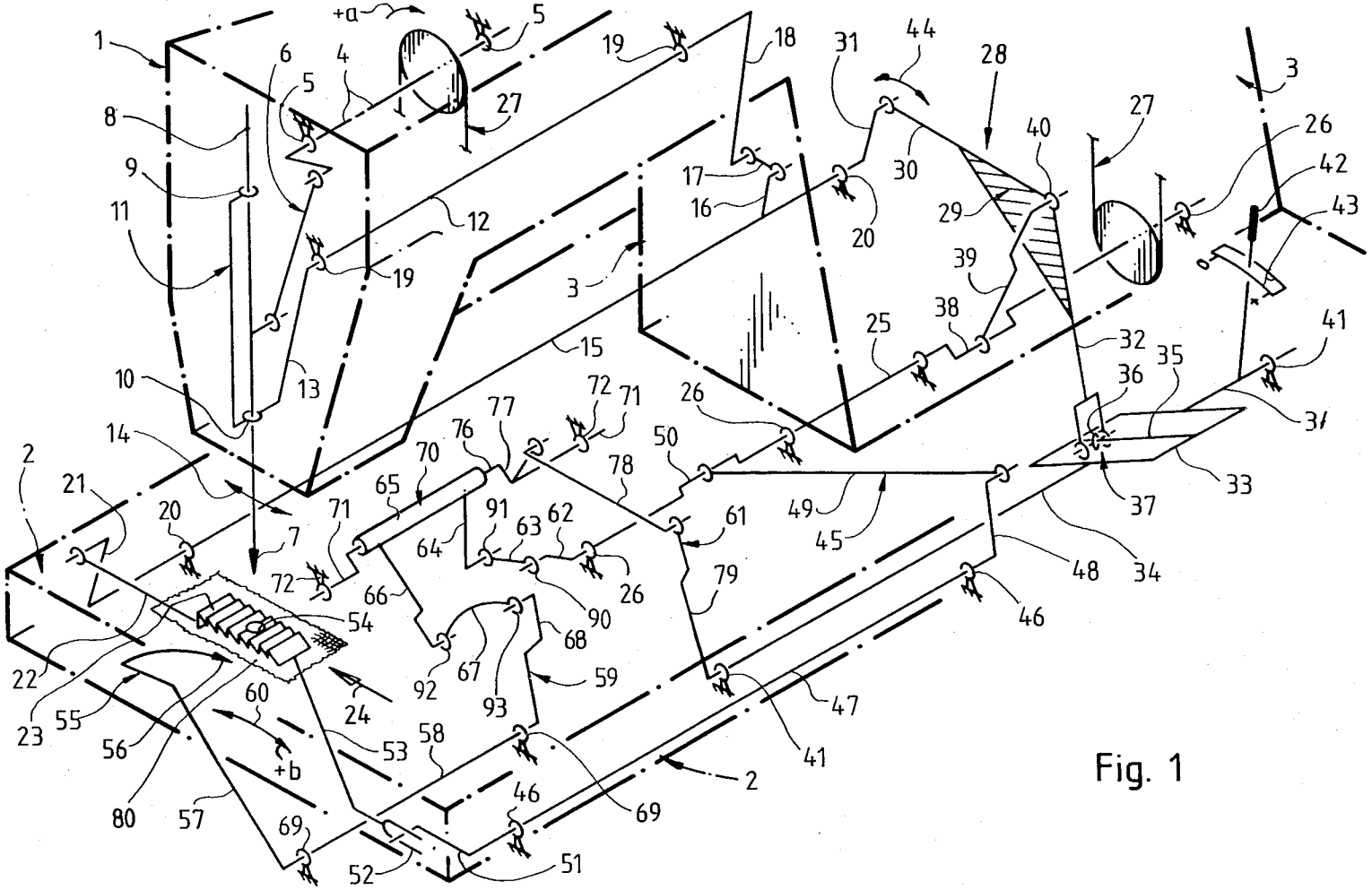
FIG. 1 is a schematic perspective view of the drive of a double chain stitch sewing machine according to the invention.

FIG. 1 is a diagrammatic representation of the drive of a sewing head, in which the upper part 1 of the sewing head, the lower part 2 of the sewing head and the standard 3 are illustrated by dot-dash lines. In the upper part 1 of the sewing head there is supported an arm shaft 4 in bearings 5. The arm shaft 4 reciprocatingly drives via a crank drive 6 a needle bar 8 carrying a needle 7. The needle bar 8 is vertically displaceable in an upper bearing 9 and a lower bearing 10. The bearings 9, 10 are secured to a needle bar bearing frame 11, which is joggingly driven by a rocking shaft 12 according to the direction of an arrow 14. The rocking shaft 12 is provided with an offset arm 13. Such a needle jogging drive is commonly known. The rocking shaft 12 is oscillatingly, i.e. not rotatingly driven by a shaft 15, which is located in the lower part 2 of the sewing head. The shaft 15 is formed with a lever 16 radially extending therefrom upwards into the standard 3. The lever 16 is connected via a link 17 to a lever 18 radially extending from the rocking shaft 12 downwards through the standard 3. As the shaft 15 is oscillatingly driven its oscillatory movement is transmitted by the two levers 16, 18 to the rocking shaft 12. The rocking shaft 12 is supported in the upper part 1 of the sewing head by means of bearings 19.

The shaft 15 is supported in the lower part 2 of the sewing head in bearings 20 and drives via a crank 21 and a connecting rod 22 a feed dog 23. The connecting rod 22 is hinged to the crank 21. The feed dog 23 is oscillatingly driven in a substantially horizontal plane, i.e. in and in opposite to a fabric motion of a direction 24. Furthermore, in the lower part 2 of the sewing head there is received in bearings 26 a shaft 25, which is driven by the arm shaft 4 via a timing belt drive 27 according to the rate of revolutions of the arm shaft 4. The shaft 25 swingably drives the shaft 15 via a rocker gear 28. The rocker gear 28 is provided with an angle lever 29, one end 30 of which is hinged to a lever 31 radially extending from the shaft 15. The other end 32 of the angle lever 29 is displaceably supported in an adjusting frame 33 secured to a tiltable adjusting shaft 34. In the adjusting frame 33 there is fastened a slide bar 35, on which is displaceably arranged a slide block 36. The latter is connected to the other end 32 of the angle lever 29 by means of a knuckle joint 37. Consequently, the angle lever 29 is capable to respond to adjustment movements of the adjusting frame 33. The oscillatory drive itself is generated by a crank 38 formed at the shaft 25. The crank 38 is connected to a tie rod 39 swingably supported in the point 40 of the angle lever 29. The adjusting shaft 34 is supported in bearings 41 located in the lower part 2 of the sewing head, and tiltable by an adjusting lever 42, which is accessible for the operator. The adjusting lever 42 is guided in a stationary guide way 43. In an end position of the guide way 43 denoted with "O", the angle position of the adjusting shaft 34 and thus the adjusting frame 33 is such, that nearly no movement is induced to the one end 30 of the angle lever 29, i.e. no movement into the fabric feeding direction resp. into the direction of the arrow 14 is imparted neither to the feed dog 23 nor to the needle bar bearing frame 11. The movement imparted to the angle lever 29 by the crank 38 and the tie rod 39 is rather completely converted into a free oscillatory movement of the other end 32 of the angle lever 29 by means of the slide block 36 situated on the slide bar 35. In this position of the adjusting lever 42, the slide bar 35 of the adjusting frame 33 substantially extends perpendicularly with respect to an imagined connecting line from the fulcrum formed by the lever 31 and the end 30 to the knuckle joint 37.

When the adjusting lever 42 is moved to "+", the angle position of the slide bar 35 changes with respect to the other end 32 of the angle lever 29, so that the movement induced by the crank 38 and the tie rod 39 is converted into an oscillatory movement of the one end 30 of the angle lever 29. Consequently, the rocker gear 28 performs a rocker movement into the direction of the arrow 44, which is converted into an oscillatory movement of the shaft 15 by means of the lever 31. The described rocker gear 28 is steplessly variable between "O" and "+". Also during the sewing operation the amount of fabric feeding resp. needle jogging movement is steplessly variable.

Moreover, from the shaft 25 there is derived via a lifting gear 45 a vertical movement of the feed dog 23, which, superposed with the described horizontal movement, leads to a substantially elliptical movement of the feed dog 23. The lifting gear 45 is provided with a lifting shaft 47 supported in bearings 46 in the lower part 2 of the sewing head. A crank 48 is formed at one end of the lifting shaft 47. To the crank 48 there is supported a tie rod 49, which in turn is supported on a lift crank 50 of the shaft 25. Consequently, an oscillatory movement is induced to the lifting shaft 47, the rocking frequency of which only depends on the rate of revolutions of the shaft 25 while the amplitude is constant. To the other end of the lifting shaft 47 there is fastened a crank 51. A slide bearing 52 connects the crank 51 to a lever 53. The lever 53 is connected to the feed dog 23. Thus, the oscillatory movement of the lifting shaft 47 is converted into an up and down movement of the feed dog 23. By the described construction it is achieved that the needle 7 performs a completely synchronous movement with respect to the feed dog 23 also when penetrating the stitch hole 54 formed in the feed dog 23. Such type of feeding action is commonly known as a so called needle-feed-movement, also called compound-feed in the trade.

The shaft 25 further oscillatingly drives a double chain stitch hook hereinafter denoted as a looper 55, which oscillates parallelly to the fabric feeding direction 24 of the feed dog 23. Thus, a so called double chain-stitch-inline-machine is concerned. The tip 56 of the looper 55 substantially operates in parallel however oppositely with respect to the fabric feeding direction 24.

The looper 55 is coupled via a lever 57 to an oscillating off-drive shaft 58 of a looper drive mechanism 59. The lever 57 projects radially from the oscillating off-drive shaft 58, so that an oscillatory movement of the oscillating off-drive shaft is converted into a correspondent oscillating movement 60 of the looper 55 resp. the looper tip 56. This movement 60 is derived from the shaft 25. A compensation gear 61 shiftably connected to the adjustment shaft 34 effects an alteration of the amplitude of the movement 60 derived from the looper drive mechanism 59 in such way, that, independent of the stitch length, the stitch forming conditions, i.e. the relation between the needle 7 and the looper tip 56 at the instant of the needle thread loop seizing and of the descending needle entering into the thread triangle, are maintained.

Figure 2:
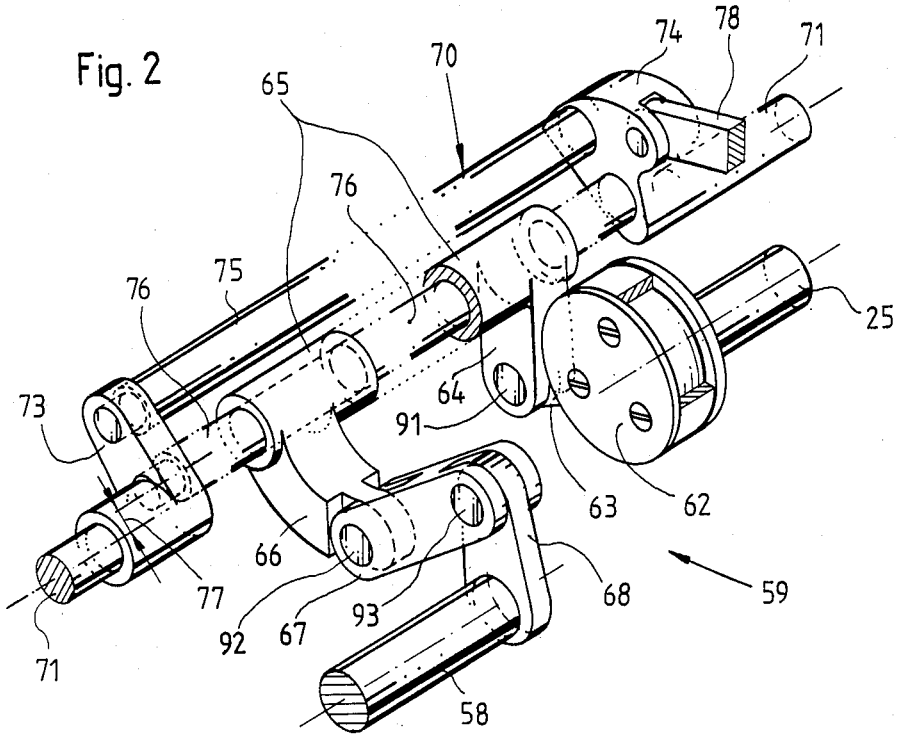
FIG. 2 is a perspective exploded view of a looper drive mechanism for the drive according to FIG. 1.

The looper drive mechanism 59 and the compensating gear 61 are illustrated more in detail in FIG. 2. In FIGS. 2 and 1 the same Ref. Nos. are used for the same components, although the respective component is only diagrammatically illustrated in FIG. 1.

The looper drive mechanism 59 is driven by a crank 62 formed at the shaft 25. The crank 62 is linked to a tie rod 63 by a pivot 90. The tie rod 63 is linked to a lever 64 by a pivot 91. The lever 64 is a part of a lever bearing 65 formed with a lever 66. As usual in the sewing machine technology, the crank 62 is realized by an eccentric as apparent from FIG. 2.

The lever 66 is linked to a tie rod 67 by a pivot 92. A lever 68 is linked to the tie rod 67 by a link 93. The lever 68 is formed at the off-drive shaft 58 received in bearings 69 of the lower part 2 of the sewing head. By this construction of the looper drive mechanism 59 a rotary movement of the shaft 25 is converted into an oscillatory movement of the looper 55 together with the looper tip 56.

It is the aim of the hereinafter described compensating gear 61 to render possible, that during operation the position of the lever bearing 65 is steplessly variable and thus to alter the amplitude and the oscillatory movement of the looper tip 56 with respect to the angular movement of the crank drive 6 driving the needle bar 8.

For this reason, a swivel bearing 70 is supported about two flushing pivot pins 71 in stationary bearings 72, which are located in the lower part of the sewing head. To the pivot pins 71 there are fixedly secured side walls 73, 74, which are connected by a connecting bar 75.

Furthermore, between the side walls 73, 74 there is secured a bearing axle 76 about which are swingably arranged lever bearings 65 for receiving levers 64 and 66. For a better clearness in the drawing the lever bearings are tubularly illustrated. In practice the lever bearing 65 together with the levers 64, 66 is formed as a plate with pivots 91, 92. The bearing axle 76 has an eccentricity 77 with respect to the pivot pins 71.

To the side wall 74 there is hinged an adjusting bar 78, which is hingedly connected to a crank 79 arranged at the adjusting shaft 34. As the adjusting shaft 34 will be tilted by the adjusting lever 42, the bearing axle 76 for the lever bearing 65 will also be tilted, i.e. the compensating gear 61 is actuated thus altering the gear ratio of the looper drive mechanism 59.

Operation of the looper drive mechanism 59 in cooperation with the compensating gear 61 is described as follows:

When the arm shaft 4 is rotated, the needle 7 secured to the needle bar 8 is reciprocatingly driven by the crank gear 6 in a vertical plane. Simultaneously, the shaft 25 is driven by the timing belt drive 27, i.e. with the same rate of revolutions and angle of rotation due to the gear ratio of 1:1. The rotation of the shaft 25 swingably drives via the rocker crank 38 the triangularly formed angle lever 29 of the rocker gear 28, so that the slide block 36 in the knuckle joint 37 moves to and fro on the slide bar 35. The angle position of the slide bar 35 may be altered by the adjusting lever 42 guided in the stationary guide way 43, so that the end 30 of the angle lever 29 imparts an oscillatory movement to the lever 31. The oscillatory movement is transmitted by the shaft 15 to the crank 21, so that the feed dog 23 performs a movement extending in the same or opposite direction of the fabric feeding direction 24. Due to the hinge connection of the shaft 15 and the rocking shaft 12 carrying needle bar bearing frame 11 via the lever 16, the link 17 and the lever 18, finally the needle 7 is reciprocatingly driven in synchronism with the feed dog 23, so that the needle 7 cooperates without collision with the stitch hole 54 formed in the feed dog 23.

The rotation of the shaft 25 also swingably drives the lifting shaft 47 via the lifting gear 45, so that, due to the connection of the lever 53 to the slide bearing 52 and the crank 51, the feed dog 23 is moved up and down, i.e. in a plane extending parallelly with respect to the needle bar 8. If the crank drive 6, the crank 38 and the lifting crank 50 are adjusted in correct phase, the feed dog 23 performs a quasi-elliptical movement, so that, when the needle 7 penetrates a workpiece 80, workpiece 80 to be sewn is advanced into fabric feeding direction 24. As, during the advancing phase, the needle 7 is located within the workpiece 80, there is spoken of a needle-feed-movement. The aforedescribed kinematic connection of the needle bar bearing frame 11 with the shaft 15 renders possible, that an alteration of the amplitude of the feed dog 23 due to an alteration of the stitch length simultaneously alters the needle jogging movement. Both is obtained by adjusting the adjusting shaft 34.

The rotation of the shaft 25 generates an oscillatory movement of the lever bearing 65, which in turn generates an oscillatory movement of the double chain stitch looper 55 coacting with the needle 7.

By the displacement of the adjusting shaft 34 the position of the lever bearing 65 is altered.

Figure 4:
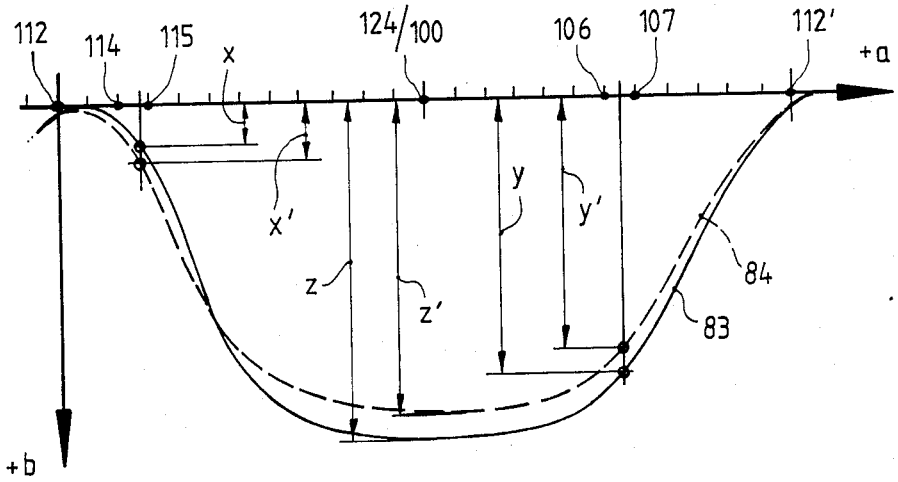
FIG. 4 is a diagram showing the tilt angle "b" of the looper with respect to the angle of rotation "a" of the crank drive for the needle.

The crank 62, the tie rod 63 and the lever 64 of the looper drive mechanism 55 form a first gear part while the lever 66 and the tie rod 67 form a second gear part, which will be considered as a two-link-group, in German literature of kinematics, e.g. Vollmer, Getriebetechnik ISBN 3528040963, called "Zweischlag". The two gear parts are such arranged to each other as the second gear part takes in its almost stretched position as the first gear part is in a position, in which the components take in a substantially superposed position to each other. In this connection the wording in several claims "... when the first gear part takes in its retracted position, the second gear part takes in its extended position ..." means that the crank 62 and the tie rod 63 take in a superposed position to each other, i.e. a matched position which is opposite to a stretched position and the tie rod 67 and the lever 66 are stretched, i.e. relatively placed in a toggle-like action. By connecting the two gear parts in series it is obtained, that the looper 55 performs a dwell-like motion while being positioned in its extreme position oppositely directed with respect to the fabric feeding direction 24. This characteristic curve of motion is illustrated in FIG. 4, at which the angle of rotation +a resp. the oscillatory movement of the looper 55 +b responds to the illustrated directions +a and +b in FIG. 1. By this it becomes apparent that the looper 55 remains in the area of extreme position almost coming to a standstill as the crank 62 resp. the arm shaft 4 moves over a larger range of angle. On the other hand the looper tip 56 performs in the area of its other extreme position, i.e. in that extreme position positioned in the fabric feeding direction 24 a quick change of movement as it becomes obvious by the steep flank of the curve of movement in FIG. 4.

By the afore described construction of the looper drive mechanism 59 it is achieved that the movement of the looper 59 may be assigned to that of the needle 7 which is reciprocatingly driven by a commonly known resp. usual crank drive 6.

Figure 3A:
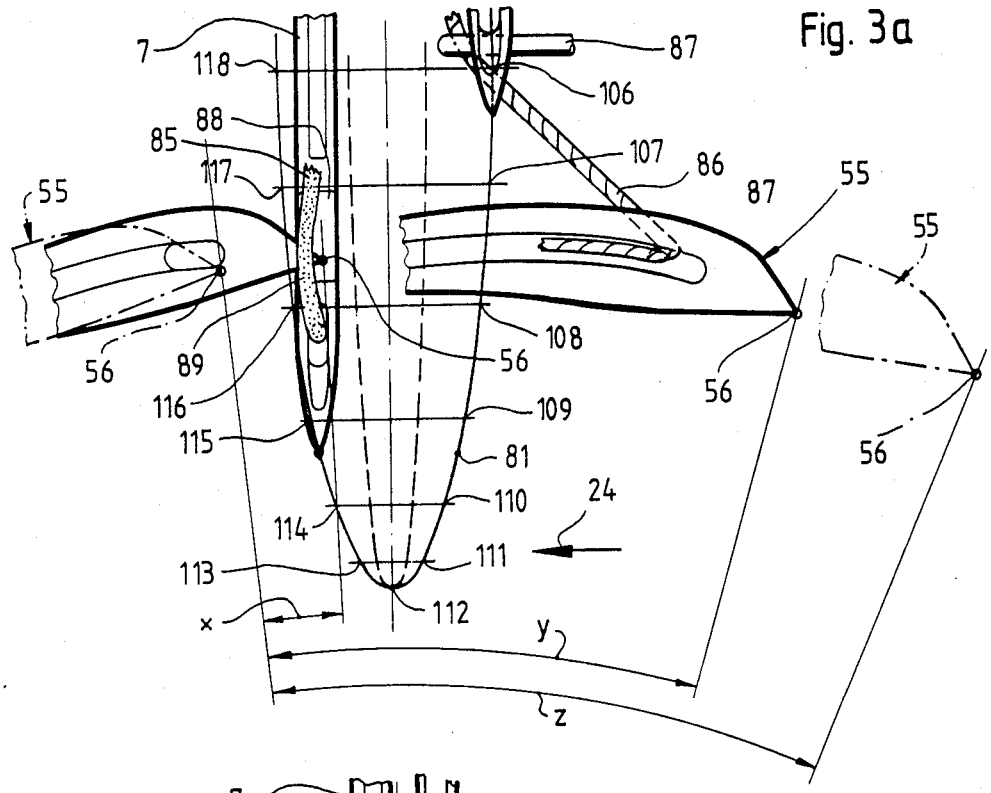
FIG. 3*a* is a kinematic diagram showing different needle positions with associated looper positions for large stitch lengths, on an enlarged scale.
Figure 3B:
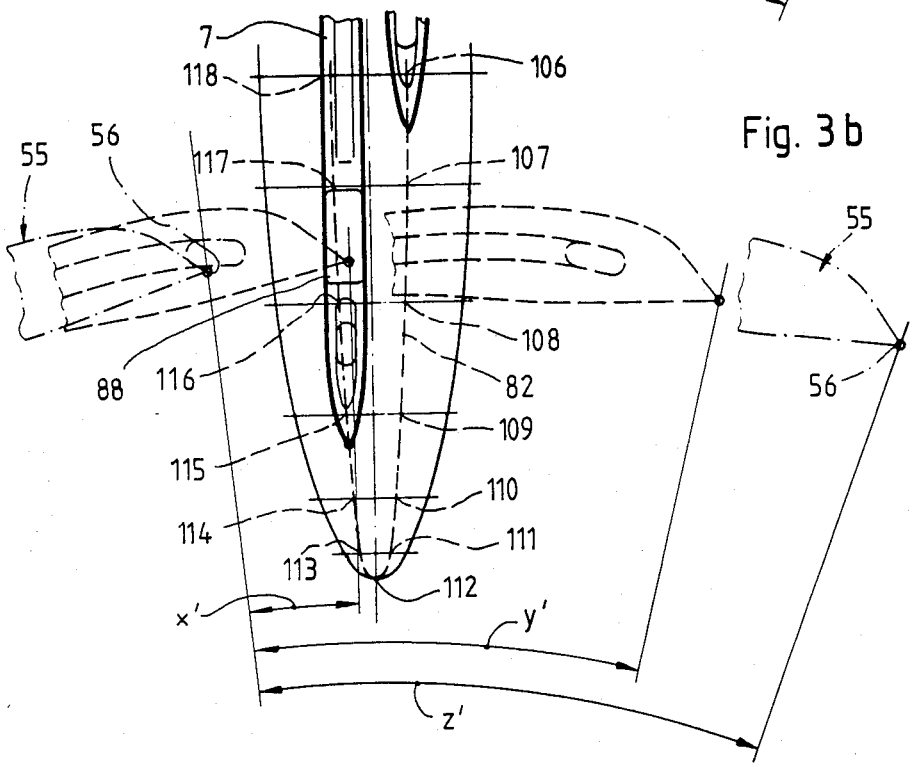
FIG. 3*b* is a kinematic diagram according to FIG. 3*a*, however for small stitch lengths.

FIGS. 3*a* and 3*b* each show the needle 7 in positions as placed below the stitch hole 54. If a large stitch length, for instance 9 mm is selected, then the needle 7 moves on a path 81 drawn in a full line (see FIG. 3*a*). If, however, a smaller stitch length, for instance 3 mm is selected, then the needle 7 moves on a path 82 drawn in a dash line (see FIG. 3*b*).

One revolution of the crank of the crank drive 6 equivalent to 360° is subdivided into 24 sections of 15° denoted with correspondent positions of 100 to 124. The position 100, which is not shown in the drawings corresponds to the upper dead center, i.e. the upper position where the needle 7 reverses its movement and the position 112 corresponds to the lower dead center of the needle 7, i.e. the so called lower needle position. In FIGS. 3*a* and 3*b* there are listed the positions 106 to 118 correspondent to an angle of 90° of the crank drive 6 each in front and behind the lower dead center of the needle 7.

The correspondent angular positions of the crank drive 6 are also listed in FIG. 4, so that in FIG. 4 the curve of tilt angle 83 of the looper tip 56 for large stitch lengths resp. the curve of tilt angle 84 of the looper tip 56 for short stitch lengths is illustrated with respect to the angle of the crank drive 6. Thus, also the assignment of an individual position of the point of the needle 7 relative to the looper tip 56 is derivable.

When the needle 7 according to FIG. 3*a* moves downwardly on a path 81, then the needle 7 is positioned in already below the stitch hole 54, i.e. the needle 7 already penetrates the workpiece 80. In the position the point of the needle reaches a thread triangle formed by the needle thread 85 and the looper thread 86 pulled open above the looper 55 by the action of the spreader 87. At this instant the looper tip 56 is in such angular position according to FIG. 4*a*, in which b=y, i.e. the looper 55 is about on an increasingly accelerating movement in fabric feeding direction 24.

Shortly after the needle 7 has passed its lower position 112 the looper tip 56 reaches its extreme position in fabric feeding direction 24, which corresponds to the upper vertex of a curve of tilt angle 83 according to FIG. 4. Subsequently, the looper tip 56 now is moved acceleratingly in opposite fabric feeding direction 24 and meets the needle 7 when the latter has reached about the position between the positions 114 and 115 corresponding to about 15° of the crank drive 6 behind the lowest needle position. A collision with the needle 7 is avoided as the needle 7 is profiled with a scarf 88. This position of the looper 55 is shown by fully drawn lines on the left side of the needle 7 in FIG. 3*a*. In this position the looper tip 56 seizes a needle thread loop 89 due to the rising movement of the needle 7 and the action of the latter at the needle thread 85. In FIG. 3*a* only for reason of clarification this needle thread loop 89 is shown slightly in a perspective way. At this instant the looper tip 56 has reached the position with corresponds to a tilt angle b=x.

As the needle 7 further rises the looper tip 56 will be accelerated oppositely to the fabric feeding direction 24. As the needle 7 still is moved up to its upper dead center corresponding to position 100/124 the looper tip 56 already reaches the area of its largest tilt angle b=z, i.e. the area of its extreme position oppositely directed with respect to the fabric feeding direction 24 as obvious from a flat lower portion of the curve of the tilt angle 83 in FIG. 4. On both sides of about 60° of the upper dead center of the needle 7 corresponding to position 100/124 the looper tip 56 is positioned according to the dot-dashed illustration in FIG. 3*a* almost in a dwell position as to be subsequently accelerated removed, at which finally the position 107 corresponding to b=y, i.e. the entering of the descending needle 7 into the thread triangle is achieved. At small stitch lengths the movement of the needle 7 corresponds to the path 82 as illustrated in FIG. 3*b*. The curve of the tilt angle 84 of the looper tip 56 is altered due to the action of the compensation gear 61. The looper tip 56 moves from its extreme position positioned in the fabric feed direction 24 as shown on the left by dot-dashed lines in FIG. 3*b* still faster corresponding to the steep falling off dashed curve of tilt angle 84 in FIG. 4, so that the looper tip 56 reaches the needle thread loop 89 at the same position of the needle 7 between the positions 114 and 115. As obvious from FIGS. 3*a* and 3*b* on one hand and from FIG. 4 on the other hand the tilt angle x' is correspondingly larger as the tilt angle b=x. Thus, the relative position of the needle 7 and the looper tip 56 is the same as at large stitch length adjustments in accordance to FIG. 3*a*.

The extreme position of the looper tip 56 oppositely directed to the fabric feeding direction 24 is reached at the same range of the crank angle as at large stitch lengths, i.e. about at positions from 120 to 104. The maximal tilt angle b=z' is smaller as at large stitch lengths.

When the needle 7 has reached about the position 107 to enter the thread triangle according to FIG. 3*b*, then the looper tip 56 is about to carry out its back movement and has a tilt angle position b=y', i.e. the looper 55 already is passed a little bit further back than illustrated in FIG. 3*a*. Its relative position with respect to the needle 7 therefore again is about the same as shown in FIG. 3*a*, i.e. the conditions as the needle 7 enters the thread triangle are about the same as shown in FIG. 3*a*.

Essential for the very optimal relative positions between the looper tip 56 and the needle 7 at the seizing of the needle thread 89 and at entering the thread triangle drawn open by the spreader 87, is the modification resp. the construction of the looper drive mechanism 59, by which the tilt angle characteristic having almost a dwell in the extreme position directed oppositely with respect to the fabric feeding direction 24. For this reason, in many cases it may be sufficient if—corresponding to the illustration in FIG. 5—only a looper drive mechanism 59' without the presence of a compensation gear is provided. As this looper drive mechanism 59' corresponds to that as illustrated in FIG. 2, for the same components the same Ref. Nos. have been employed, and only for differentiation provided with upset indices "'". As obvious from FIG. 5 the bearing axle 76' flushes with the bearing pin 71'. Due to the strongly accelerated, i.e. very quick movement of the looper tip 56 according to the steep section of the curve of tilt angle 83 resp. 84, the looper tip 56 requires a few degrees of angle at the crank drive 6 only as to be moved out of the position drawn left in FIG. 3*a* by regular lines into the position shown left in FIG. 3*b* by dotted lines, which corresponds to the alteration of the tilt angle from x to x'. The corresponding is applicable for the range y and y', i.e. for the position relating to the needle entering the thread triangle.

Figure 5:
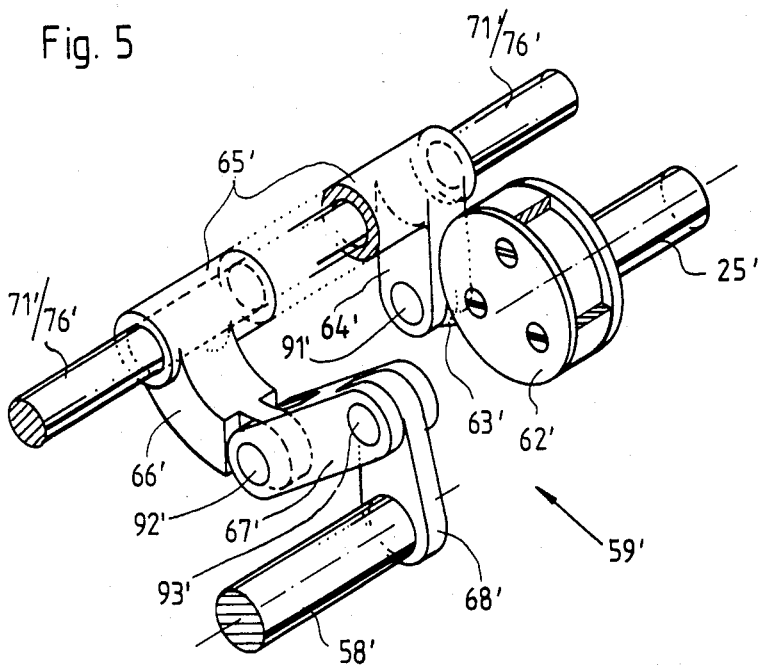
FIG. 5 is a perspective exploded view of a looper drive mechanism, which, in comparison with FIG. 2, is not provided with a stitch length compensation.
Figure 6:
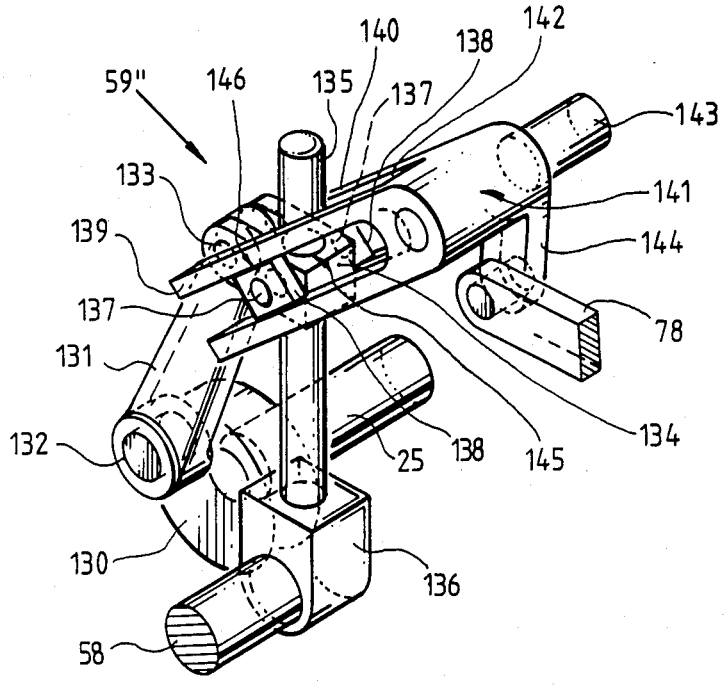
FIG. 6 is a perspective view of a further embodiment of the looper drive mechanism and FIGS. 7*a*–7*e* are schematic representations of looper drive mechanisms illustrated as kinematic linkages.

In FIG. 6 a further modified embodiment of a looper drive mechanism 59" is illustrated. This mechanism also represents a six-bar-linkage mechanism incorporating three pivots, at which—in comparison with the embodiments according to FIGS. 2 and 5—two rotary pivots are replaced by two sliding pivots.

On the shaft 25 there is arranged a crank 130, to which a tie rod 131 is connected by means of a pivot 132. The other end of the tie rod 131 is connected to a slide bearing 134 by means of a pivot 133. The slide bearing 134 is slidably received on a slide bar 135, which is a part of a crank piece 136 rotatably secured on the off-drive shaft 58.

The slide bearing 134 is provided at each side of an imaginable plane of symmetry with a stud 137, each of which tiltably receiving a slide block 138. The slide blocks 138 are displaceably received in forks 139, 140 as parts of a guide way 141. Between the forks 139, 140 the guide way 141 is provided with a recess 142, in which the slide bearing 134 is arranged with play. The guide way 141 is provided at its end turned away from the tie rod 131 with a bearing pin 143. The latter is received in a bearing (not shown) corresponding to the bearing 72 in FIG. 1 as part of the lower part 2 of the sewing head.

Furthermore, the guide way 141 is provided with a lever 144 at which is pivoted the adjusting bar 78.

The operation of this looper drive mechanism 59" is described as follows:

It is assumed for this description that the guide way 141 is kept in a definite angular position which corresponds to a definite position of the adjusting bar 78 and thus to a definite position of the adjusting lever 42. By the rotation of the shaft 25 the crank 130 moves a slide link 145 formed by the slide bearing 134 and the slide bar 135. The inclination of the slide bearing 134 is determined by the slide bar 135. At this, the slide blocks 138 are displaced in the forks 139, 140, which causes a tilting of the slide bar 135 and thus of the off-drive shaft 58. A further slide link 146 is formed by the slide blocks 137 and 138 and the forks 139 and 140. The superposition of movements of both slide links 145, 146 leads to a motion of the looper tip 56 diagrammatically shown above the angle of the crank drive 6 as shown in FIG. 4.

At this looper drive mechanism 59" the characteristic flattening of the curve as illustrated in FIG. 4 is obtained if the crank 130 and the tie rod 131 take in their stretched positions, and at this, the slide bar 135 and the forks 139, 140 almost get in parallel.

At tilting of the guide way 141 by means of the adjusting bar 78 an altered tilt motion of the off-drive shaft 58 is achieved.

An alteration of the position of the bearing 76 according to FIG. 1 corresponds to an alteration of the direction of the slide link 146.

Figure 7A:
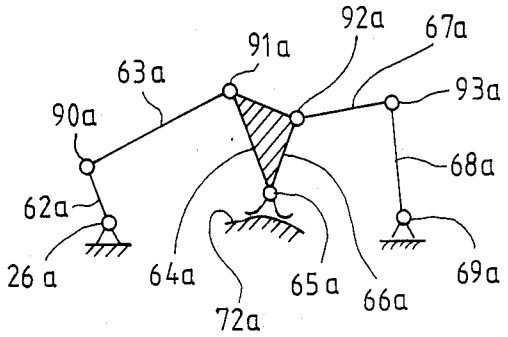

In FIG. 7*a* there is published a kinematic principle of the embodiment according to FIG. 2. As to make this apparent, the individual Ref. Nos. from FIG. 2 are converted to FIG. 7*a*, however here denoted with an additional "a". Moreover, the illustrated circles represent the individual pivots. They are marked with the Ref. Nos. for pivots as illustrated in FIGS. 1 and 2. The illustration represents a six-bar-linkage mechanism including three stationary pivots. Six bars are represented by the crank 62, the tie rod 63, the lever 64, the lever 66, the tie rod 67 and the lever 68 resp. the corresponding kinematic members 62*a*, 63*a*, 64*a*, 66*a*, 67*a*, 68*a*. The lever bearings 65 resp. 65*a, b, c* and the bearings 69 resp. 69*a, b, c* will be denoted as pivots. A linkage mechanism comprising three stationary pivots is then existent, because there are three positions of a suspension as the pivots 26, 69 and 65 resp. the corresponding kinematic pivots 26*a*, 65*a*, 69*a*, at which the pivot 65*a* is locatable as the correspondent pivot 65. From the illustration of the kinematic chain in FIG. 7*a* it is also recognisable, that at the retracted position of the first gear part formed by the kinematic elements 62*a* and 63*a* the other gear part formed by the kinematic elements 67*a* and 68*a* takes in its extended resp. stretched position. Furthermore, it is understandable, that the levers 64, 66 resp. the correspondent kinematic elements 64*a*, 66*a* are positioned to each other by a fixed angle, at which the pivot 92*a*, by means of which the tie rod 67*a* is linked to the lever 66*a*, moves on a circular path.

Figure 7B:
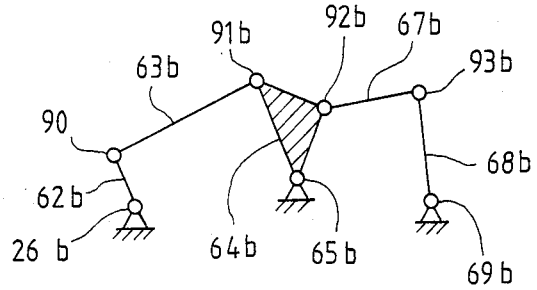

In FIG. 7*b* there is illustrated a kinematic principle of the embodiment according to FIG. 5 in form of a kinematic chain, i.e. the looper drive mechanism without the compensation gear. Thus, the kinematic chain matches with that of FIG. 7*a* except the one difference, that the lever bearing 65 is not relocatable, since the bearing axle 76 is unrelocatably arranged. The individual kinematic elements in FIG. 7*b* are denoted with corresponding Ref. Nos. however extended by a "b".

Figure 7C:
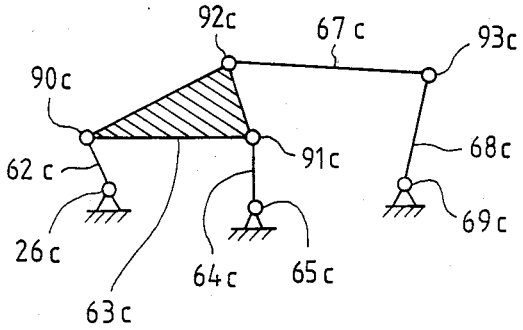

As obvious from FIG. 7*c* for the drive of a looper of a double chain stitch sewing machine also a six-bar-linkage mechanism including three stationary pivots is imaginable, at which the two-link-group is formed by the kinematic elements 67*c* and 68*c* is derived from a pivot 92*c*, which, oppositely to the embodiment of FIGS. 7*a* and 7*b*, does not move on a circular path but on a compound path which is such as generated as a four-bar-linkage mechanism formed by the kinematic pivots 26*c*, 90*c*, 91*c*, 65*c*.

Figure 7E:
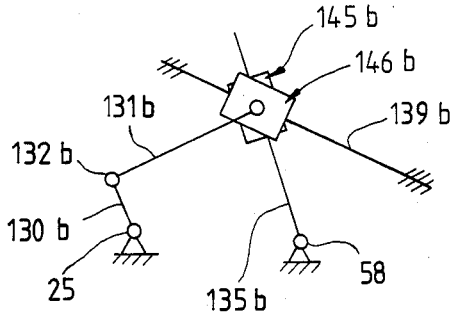
Figure 7D:
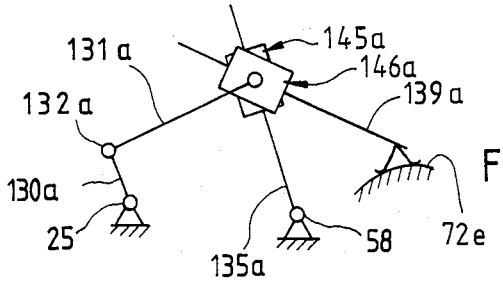

FIG. 7*d* shows the kinematic principle of the embodiment according to FIG. 6. In FIG. 7*d* the individual Ref. Nos. as in FIG. 6 are used, however with an added "a". As especially obvious from this illustration the success as described and especially illustrated in FIG. 4 is also achieved, if definite gear dimensions are such as applied that they kinematically considered take in the value $\infty$. This means kinematically, that final dimensions of link members are replaced by straight guiding members, i.e. rotary pivots are displaced by slide pivots.

The modification of the kinematic chain according to FIG. 7*e* exists by the fact, that here, like the embodiment according to FIG. 7*b*, no relocatable stationary pivot (point of suspension) is provided. This means that there is no possibility of alteration resp. relocation by means of the adjusting lever 42. Also in FIG. 7*e* the Ref. Nos. of FIG. 6 are employed however added by a "b".

What is claimed is:

1. A double chain stitch swing machine having:

a feed device swingably driven in and oppositely to a fabric feeding direction for generating a relative motion as a feed movement between a sewing head and a workpiece;

a needle bar with a needle synchronously drivable with respect to said relative motion and reciprocatingly driven by a crank drive;

adjustment means for commonly adjusting said feeding device and said needle on different stitch lengths;

a double chain stitch looper swingably driven in and oppositely to said fabric feeding direction and cooperating with said needle; and a looper drive mechanism formed as a six-bar-linkage mechanism having three stationary pivots, said pivots comprising:

a first pivot at the drive input, a second pivot at the drive output and an intermediate pivot, said looper drive mechanism generating a swing motion of said looper of high velocity to and from an extreme position placed in said fabric feeding direction, at which a short period of dwell is achieved in said extreme position and a long period of dwell is achieved in an oppositely directed extreme position, and said intermediate pivot being relocatably provided.

2. A double chain stitch sewing machine according to claim 1, said looper drive mechanism comprising:

a first gear part of the kind of a crank gear; and a second gear part of the kind of a two-link-group, said first gear part being drivably linked to said second gear part, at which the arrangement of said two gear parts is such as when the first gear part takes in its retracted position the second gear part takes in its extended position.

3. A double chain stitch sewing machine according to claim 1, said intermediate pivot being formed as a swivel bearing linked to said adjustment means.

4. A double chain stitch sewing machine having:

a feeding device swingably driven in and oppositely to a fabric feeding direction for generating a relative motion as a feed movement between a sewing head and a workpiece;

a needle bar with a needle synchronously drivable with respect to said relative motion and reciprocatingly driven by a crank drive;

adjustment means for commonly adjusting said feeding device and said needle on different stitch lengths;

a double chain stitch looper swingably driven in and oppositely to said fabric feeding direction and cooperating with said needle; and a looper drive mechanism formed as a six-bar-linkage mechanism having three stationary pivots, said mechanism comprising a first pivot at the drive input;

a second pivot at the drive output;

an intermediate pivot;

a first gear part of the kind of a crank gear; and a second gear part of the kind of a two-link-group, said first gear part being drivably linked to said second gear part, at which the arrangement of said two gear parts is such as when the first gear part takes in its retracted position the second gear part takes in its extended position for generating a swing motion of said looper of high velocity to and from an extreme position placed in said fabric feeding direction, at which a short period of dwell is achieved in said extreme position and a long period of dwell is achieved in an oppositely directed extreme position, and said intermediate pivot being relocatably provided.

5. A double chain stitch sewing machine according to claim 4, said intermediate pivot being formed as a swivel bearing linked to said adjustment means.

* * * * *